US010279937B2

(12) United States Patent
Frenzel et al.

(10) Patent No.: US 10,279,937 B2
(45) Date of Patent: May 7, 2019

(54) DEVICE FOR WRAPPING A STACK OF GOODS WITH A TUBULAR HOOD AND METHOD FOR CHANGING THE TUBULAR FILM STOCK IN AN APPROPRIATE DEVICE

(71) Applicant: Maschinenfabrik Mollers GmbH, Beckum (DE)

(72) Inventors: Norbert Frenzel, Soest (DE); Ludger Schwarte, Wadersloh (DE)

(73) Assignee: Maschinefabrik Mollers GmbH, Beckum (DE)

( * ) Notice: Subject to any disclaimer, the term of this patent is extended or adjusted under 35 U.S.C. 154(b) by 0 days.

(21) Appl. No.: 15/671,505

(22) Filed: Aug. 8, 2017

(65) Prior Publication Data

US 2018/0044043 A1 Feb. 15, 2018

(30) Foreign Application Priority Data

Aug. 10, 2016 (EP) ..... 16183492

(51) Int. Cl.
*B65B 9/13* (2006.01)
*B65B 35/40* (2006.01)
(Continued)

(52) U.S. Cl.
CPC ..... *B65B 9/135* (2013.01); *B65B 35/405* (2013.01); *B65B 41/12* (2013.01); *B65B 59/02* (2013.01);
(Continued)

(58) Field of Classification Search
CPC .. B65B 9/13; B65B 9/135; B65B 9/14; B65B 35/50; B65B 35/52; B65H 2301/543;
(Continued)

(56) References Cited

U.S. PATENT DOCUMENTS 3,387,429 A * 6/1968 Peabody, Jr. ..... B65B 41/06 493/252
3,717,057 A * 2/1973 Takimoto ..... B65H 19/1836 83/98

(Continued)

FOREIGN PATENT DOCUMENTS

DE 19612416 A1 * 10/1997 ..... B65H 19/107
EP 0184485 A1 6/1986
EP 2377762 A1 10/2011

OTHER PUBLICATIONS

European Search Report 16183492.4, dated Feb. 10, 2017.

*Primary Examiner* — Stephen F. Gerrity
*Assistant Examiner* — Joshua G Kotis
(74) *Attorney, Agent, or Firm* — Fishman Stewart PLLC

(57) ABSTRACT

The present invention relates to a device for wrapping a piece item stack, which is formed of a plurality of piece item parts that are disposed on top of one another, with a tubular film, wherein the device has a tubular film stock, a conveyor device for pulling a predetermined length of tubular film out of the tubular film stock, a cutting device for cutting the pulled-off tubular film for the formation of a tubular hood and a fitting device, which is arranged downstream of the cutting device in the conveying direction of the tubular film, for pulling the tubular hood over the piece item stack, as well as a method for changing the tubular film stock in such a device. For enhanced safety and guarantee of a disturbance-free operation, a discharge device, which can discharge a length piece (L) of the tubular film, is proposed with the present invention as a part of the device for wrapping the piece item stack. In the method for changing the tubular film stock according to the invention, a lagging end of a consumed tubular film stock is connected to the leading end of a new tubular film stock, wherein the leading end and the lagging end are conveyed in the direction onto the cutting (Continued)

device in order to laterally discharge a length section (L) that bears the leading and the lagging end on top of an intake area for the piece item stack.

8 Claims, 4 Drawing Sheets

(51) Int. Cl.
*B65B 59/02* (2006.01)
*B65B 41/12* (2006.01)
*B65B 35/50* (2006.01)
*B65B 1/00* (2006.01)
*B65B 61/00* (2006.01)

(52) U.S. Cl.
CPC ..... *B65B 61/00* (2013.01); *B65B 35/50* (2013.01); *B65B 2220/06* (2013.01); *B65D 2571/0003* (2013.01)

(58) Field of Classification Search
CPC ..... B65H 19/107; B65H 19/20; B65H 2301/46152–2301/46178
USPC ..... 156/267; 53/389.1–389.5, 218, 441, 459, 53/556, 567
See application file for complete search history.

(56) References Cited

U.S. PATENT DOCUMENTS 4,632,321 A * 12/1986 Danler ..... B02C 18/148 241/101.4
4,976,089 A * 12/1990 Reichelt ..... B65B 57/04 53/389.3
5,388,387 A * 2/1995 McElvy ..... B65B 9/207 156/502
5,474,252 A * 12/1995 Schmid ..... B65H 19/107 156/159
6,032,439 A * 3/2000 Birkenfeld ..... B65B 9/135 53/441
6,547,179 B1 * 4/2003 Klas ..... B65H 19/107 242/554.2
2003/0164076 A1 * 9/2003 Klas ..... B65H 19/1805 83/13
2004/0250510 A1 * 12/2004 Dalietos ..... B65B 25/148 53/399
2011/0258970 A1 * 10/2011 Michels ..... B65B 9/135 53/461
2017/0073092 A1 * 3/2017 Bocedi ..... B65B 11/02

* cited by examiner

DEVICE FOR WRAPPING A STACK OF GOODS WITH A TUBULAR HOOD AND METHOD FOR CHANGING THE TUBULAR FILM STOCK IN AN APPROPRIATE DEVICE

CROSS-REFERENCE TO RELATED APPLICATIONS

This application claims priority to European Patent Application No. 16 183 492.4, filed Aug. 10, 2016, the contents of which are hereby incorporated by reference in its entirety.

TECHNICAL FIELD

The present invention relates to packaging of piece item stacks that are formed of a plurality of piece item parts. Such a device is known for example from the EP 1 013 549 A1 filed by the applicant. The present invention relates in particular to wrapping of stacks of goods that are formed of a plurality of sacks. Such stacks of goods are wrapped with a shrink or tubular hood that is respectively formed of a length piece of a tubular film, wherein the tubular film is usually welded for forming a tubular hood on the closed end of the tubular hood to be formed and separated from the fed material of the tubular film stock. These method steps are usually performed before the tubular film is pulled over the stack of goods. For fitting, the material of the tubular film is usually deposited on fingers that are moved in an upward direction along the stack of goods, wherein the film is pulled off the fingers and aligns itself in parallel to the lateral walls of the stack of goods. The film can be processed as a shrink film in the process.

BACKGROUND

In this process, the tubular film material is usually pulled over the piece item stack without any tension. Afterwards, heat is applied onto the film material, wherein molecular orientations within the film material relax and the film is put in close contact with the contour of the piece item stack. However, the tubular film can equally be stretched elastically to an excessive size and put itself elastically in contact with the contour of the piece item stack during fitting without a separate heat input being required. The device according to the invention and the respective method according to the invention are therefore suitable both for shrinking the tubular film as well as for stretching of said tubular film.

During change of the tubular film stock in the device, the lagging end of the consumed tubular film stock is connected to the leading end of the new tubular film stock. Connected to form a unit in this way, the films of the new and the old tubular film stock are conveyed and fed in the direction onto the cutting device. Said cutting device is operated in the previously known method in a way that the connection area between the leading and the lagging end is separated by the cutting device. Then, it falls into an input area for the piece item stack due to gravity. This separated length section will then have the leading and the lagging end. These two ends are pulled by conveyer rollers of the conveyor device prior to separation with the cutting device so that the new film material does not have to be inserted there.

SUMMARY

The present invention is based on the problem of indicating an improved device for wrapping a piece item stack and an appropriate method.

According to the present invention, a device is indicated to solve this problem. This known device has a cutting device for cutting the tubular film pulled off from the film stock in a way that is known in principle. This cutting device can be combined with a welding device to weld the tubular film on its upper side and to subsequently form a tubular hood that is closed on the upper side. However, this characteristic is not inventively substantial for the present invention. It is definitely conceivable to also put a film hood in an unsealed way on the upper side around a piece item stack in order to connect the individual piece good parts to a unit and to secure said piece good parts, wherein a weather protection and hence an upper closure of the film hood by means of a transversal welding seam is not relevant. In a way that is known in principle, the device has a fitting unit for putting the film hood over the piece item stack and in addition a conveyor device for pulling a predetermined length of tubular film out of the tubular film stock. According to the invention, also a discharge device for discharging a length section of the tubular film is provided. This discharge device is usually provided downstream of the cutting device so that the connected leading and lagging ends can at first pass the cutting device in order to interact with the discharge device, which usually diverts the length section above the intake area for the piece item stack and normally conveys said length section laterally out of the device, so that the length section does not fall into the intake area, which is usual in the state of the art. This is because the length section has to be diverted manually at that point, which requires the operation of the device to be interrupted due to the safety of the operating staff that has to be ensured.

The device according to the invention and the method according to the invention provide a solution to this problem by means of a discharge device through which the length section is diverted in an automated way and discharged out of the actual device, i.e. moved away from said device as far as to prevent the operation of the device for wrapping the piece item stack from being affected and to ensure the continuation of said operation even when the tubular film stock is changed.

According to a preferred further development of the present invention, the discharge device is provided downstream of the cutting device in the conveying direction of the tubular film. This preferred variant is explained by the condition that the intake area for the piece item stack is usually provided in an upward direction, i.e. downstream in the direction of gravity of the cutting device, i.e. below the cutting device. This way, the area connected between the lagging and the leading end can be cut by the cutting device and come in contact with the discharge device in a downstream direction in the field of gravity of the Earth in order to be discharged there by said discharge device. In this context, the cutting device is usually provided in combination with the welding device. A spreading device is usually arranged downstream of the cutting device in case of the device according to the invention. Through this spreading device, the spread film that is fed in as flat material is put on so that the fitting device can encroach in the spread film that is open on the bottom side. This spreading device is usually provided directly underneath the cutting and/or welding device, in which first the cutting device and subsequently the welding device is usually provided in the conveying direction of the tubular film so that the tubular hood can be welded off and simultaneously separated from the fed tubular film material during an interruption of the film conveyor device.

With a further development of the present invention, the discharge device of the spreading device is positioned upstream of the tubular film in the conveying direction, preferably between the welding and/or cutting device and the spreading device. Therefore, a compact but functional device is created that prevents the length section to be discharged reliably from moving into the operating area of the spreading unit and from affecting the functional components of said spreading unit at this point. This applies accordingly for the fitting device. The length section to be discharged can neither affect the undisturbed operation there, nor interact with sensors that are potentially provided there and that monitor the orderly operation of the device.

Furthermore, the conveyor device is preferably provided with conveyor rollers that clamp the tubular film. These conveyor rollers are provided in the way that is known in principle upstream of the welding and/or cutting device in the conveying direction, i.e. in the gravitational field of the Earth above said welding and/or cutting device. Accordingly, the tubular film is conveyed, i.e. lowered, preferably in the direction onto the welding and/or cutting device in the gravitational field of the Earth so that complicated guiding devices are not required and that the length section to be discharged can be lowered and/or let fall onto the discharge device via the conveyor rollers.

According to a preferred further development of the present invention, the discharge device has a conveyor element that can be moved from a resting position into a discharge position and in which the conveyor element is provided in the gravitational field of the Earth underneath the welding and/or cutting device. In this discharge position, the length section conveyed in the direction onto the fitting device comes in contact with the conveying element so that said length section can be discharged. In the resting position, by contrast, there is no conveyor element in the gravitational field of the Earth directly underneath the welding and/or cutting device so that the tubular film can be put on from there via the spreading device and/or grabbed by the fitting device and pulled over the piece item stack. Accordingly, the conveyor element enables conventional operation of the device in the resting position whereas the length section can be conveyed away and discharged in the discharge position. The movement from the resting position into the discharge position can occur through a translational or swivel movement of a return pulley on the discharge side.

The conveyor element can be formed by a gripping arm or the like that grabs and discharges the tubular film. Meanwhile, a continuously circulating conveyor means is provided in a simple way that is deflected around a return pulley, which is provided on the edge of a rack that frames the piece item stack to be wrapped, on the drop-off side. This rack usually carries the welding and/or cutting device in a regular way on its upper side as well as normally also the conveyor device. Furthermore, the rack laterally holds a film stock. The intake area for the piece item stack to be wrapped, which is framed by the rack, is usually scanned by sensors on the outer side, which record the presence of a foreign body or human being within the racks and interrupt the operation in an automated way in such a case in order to avoid personal injury and/or material damage. The return pulley on the dropping side is located on the edge of the rack, i.e. preferably in a way that the discharged length section falls outside of the frame and that there is no risk of the length section interacting with the sensors. Therefore, the discharged length section can be removed manually and without danger to life and health of the operator after discharge and lowering to the floor. For this purpose, for example sliding surfaces, which facilitate sliding-off of the discharged length section due to gravitational force and which put said length section onto a predetermined path, can be provided on the external side of the frame.

The device according to the invention can be formed as a film guiding system with a double head that is able to maintain two different films in parallel to one another. For this purpose, the device usually has two conveyor devices that are to be operated separately from one another, wherein the first conveyor device is allocated to a first tubular film and a second conveyor device is allocated to a second tubular film. This device offers the possibility to provide two identically formed tubular films in the area of the conveyor device so that one tubular film is in a waiting position in the conveyor device. When the other tubular film is consumed, the operation can be maintained directly by means of driving the first tubular film. The lagging end of the other tubular film can in the meantime be connected with the leading end of the further tubular film stock to this other tubular film, wherein the useless length piece can be conveyed, cut and discharged during the operation of the device. For example during fitting of the tubular hood made of one tubular film material, the other tubular film material can be prepared through discharge of the useless length section. This is because wrapping of the piece item stack is not affected by a discharge device that might be located in the conveying path of the film while the tubular film is being pulled over the piece item stack.

The proposed approach to solve the problem according to the method is defined herein. In this method, the length section is preferably only cut off after the length section has started to interact with the discharge device that triggers the discharge process. If the discharge device is formed by a flexible conveyor element, this interaction arises as soon as the length section hits the conveyor device, where appropriate the continuously circulating conveyor system or grabbing of the length section by a gripping arm. Only if the length section can be controlled in this way by the discharge device, the other end of the length section, which is still connected to the conveyor device until then, will be separated and consequently become freely flexible.

BRIEF DESCRIPTION OF THE DRAWINGS

Further details and advantages of the present invention can be derived from the following description of an embodiment in connection with the drawing. In this drawing, the Figures show.

DETAILED DESCRIPTION

Figure 1:
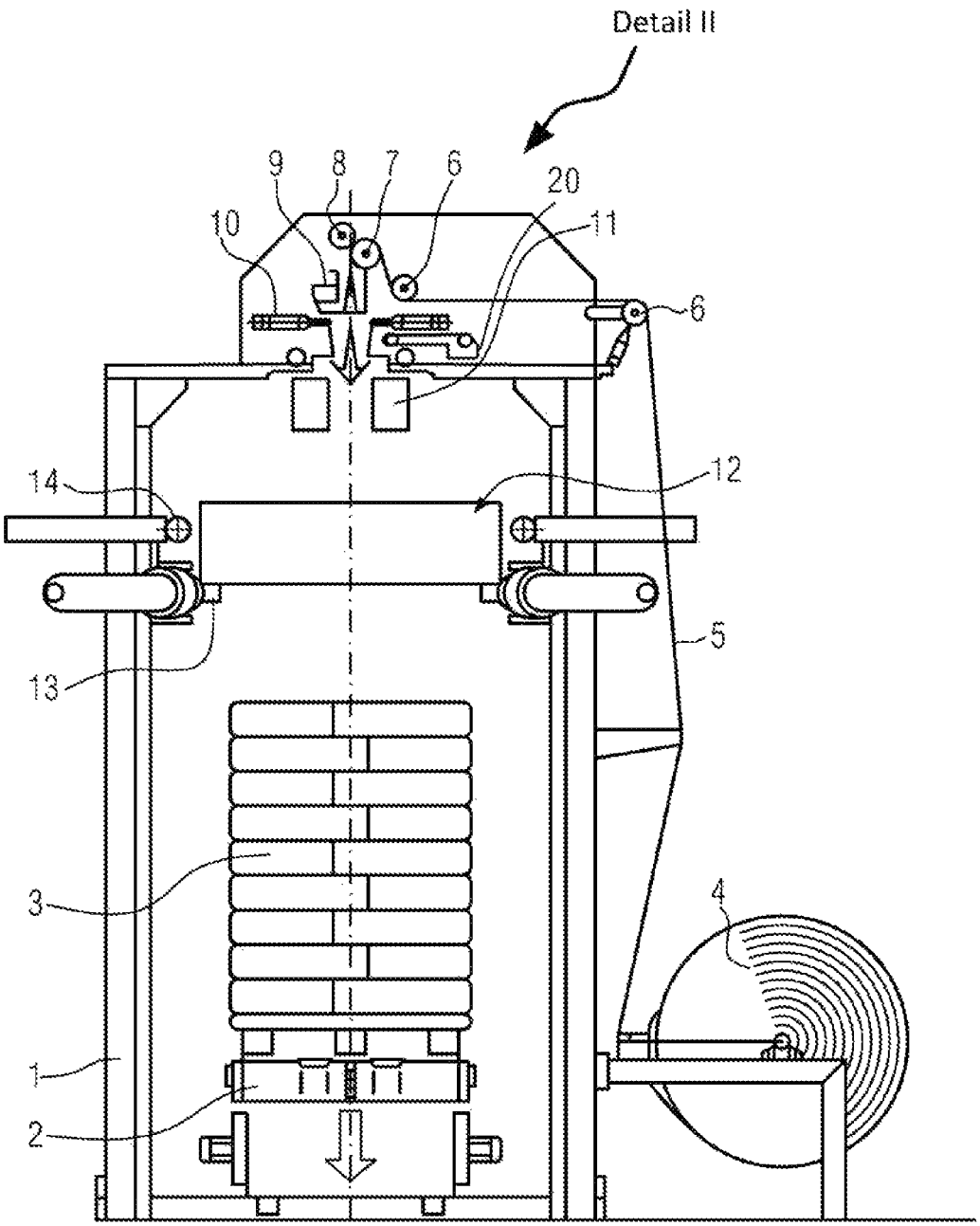
FIG. 1 a side view of an embodiment.

The embodiment of a device according to the invention shown in FIG. 1 comprises a rack 1 between whose vertical stands a lane 2 for intake and discharge of piece item stacks 3, which are formed respectively of a plurality of piece item parts in form of sacks that are arranged on top of one another or next to each other, is disposed. A roll 4, on which a tubular film 5 is wound up, is installed in a freely flexible way on the rack 1. The lateral edges of the tubular film 5 are inward-folded in the wound up state. Subsequently, the used film is a satchel sleeve 5. The tubular film 5 is fed into a conveyor device, which is formed by two conveyor rollers 7, 8, via return pulleys 6, wherein the conveyor roller marked with reference sign 7 is engine-driven and the tubular film is clamped between the conveyor roller 7 and the conveyor roller 8. Underneath this conveyor device 7, 8 there is a cutting device 9 that is suitable to separate the tubular film material that hangs down from the conveyor rollers 7, 8. In the conveyor device behind this cutting device 9, there is a welding device 10 with sealing jaws that can be moved towards one another that is provided upstream of a spreading device 11 in the conveying direction of the tubular film 5 and hence in the gravitational field of the Earth. The spreading device 11 has suction boxes that can be moved on rails, that hold the material of the tubular film 5 through negative pressure and that can be moved longitudinally and/or transversally to one another in order to open the satchel sleeve for the encroachment of a fitting device 12 into the tubular film 5 (cf. DE 20 2014 102 841 U1).

The fitting device 12 comprises gripping fingers 13 that can be moved synchronously, i.e. vertically, in the upward direction of the vertical stands and that can encroach in the opened tubular film. The gripping fingers 13 can also be moved horizontally towards one another and/or away from one another to encroach on one hand et first into the tubular film 5 that is opened at the bottom side and to subsequently stretch said tubular film into a dimension that is larger than the base area of the piece item stack 3. In this process, the tubular film 5 can be stretched elastically as known from the EP 1 013 549 A1 of the applicant. The structure of a device for wrapping a piece item stack described before is essentially prescribed and explained in the EP 2 719 628 B1 and/or the EP 2 336 033 B1 or the DE 10 2013 019 576 B4 or rather the DE 1 938 960 C1.

As in the state of the art mentioned before, the gripping fingers 13 are respectively associated with drive rolls 14 that clamp the tubular film material between themselves and the gripping fingers 13 after encroachment of the spreading fingers 13 into the tubular film 4 and that can hit the gripping fingers 13 by means of a drive. During lowering of the individual gripping fingers 13 along the piece item stack 3 and in the upward direction of said piece item stack, the tubular film 5 reefed this way is removed and/or pulled off from the gripping fingers 13 and laid against the piece item stack 3. Prior to this, a tubular hood, which is closed on the upper side and whose lid fits tight against the upper side of the piece item stack 3 while the gripping fingers 13 are being lowered and therefore constitutes an opposing resistance that ensures that the films will be pulled off from the gripping fingers 13, is usually formed by means of actuating the cutting device 9 and the welding device 10. Hence, the drive rolls 14 do not necessarily have to be operated contrarily to the reefing direction during fitting in order to discharge the material of the tubular film 5 away from the gripping fingers 13.

Figure 2:
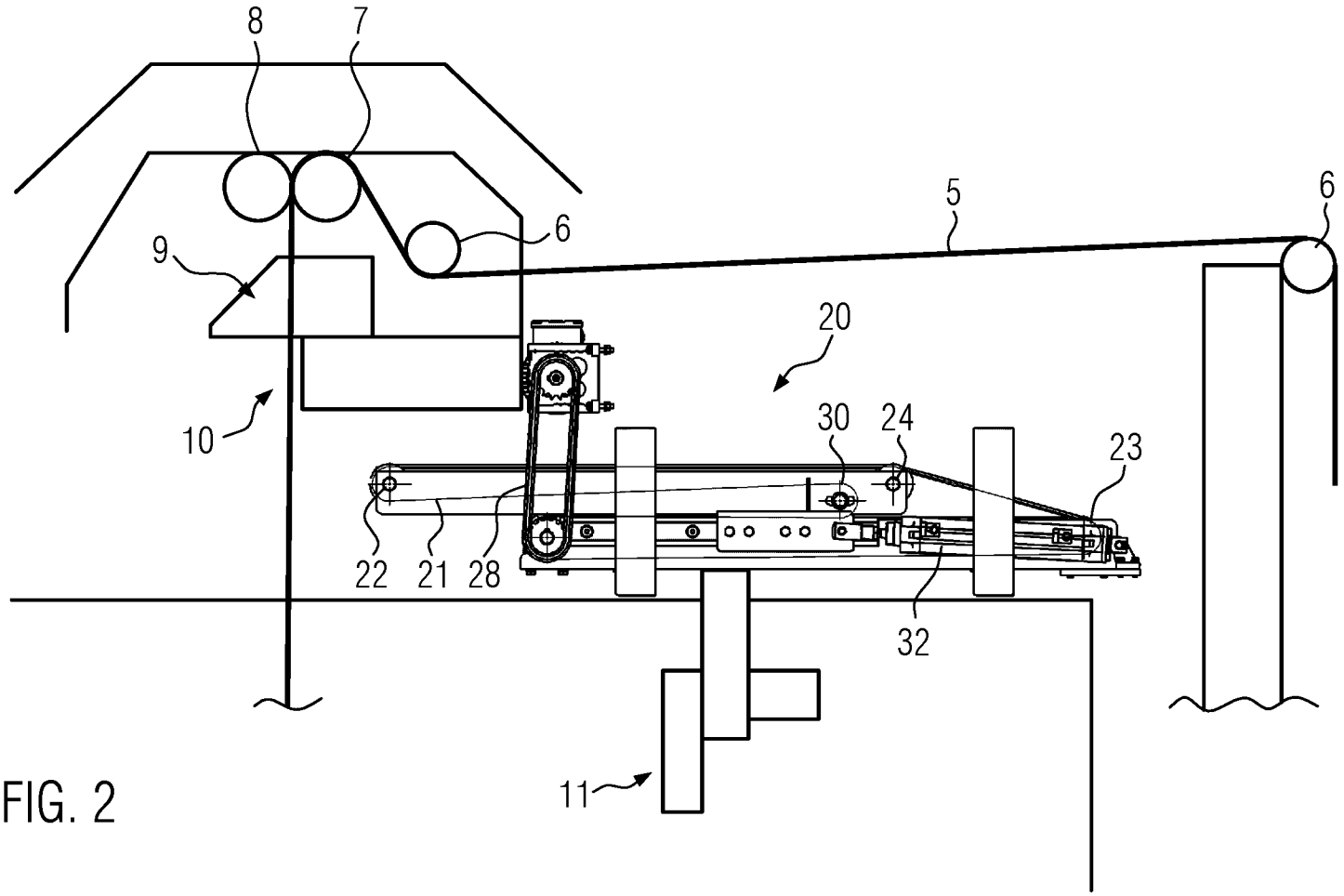
FIG. 2 the Detail II indicated in FIG. 1 in an enlarged view in a resting position of the discharge device FIG. 3 the Detail II according to FIG. 2 in a discharge position of the discharge device and FIG. 4 a perspective top view of the discharge device of the displayed embodiment.
Figure 3:
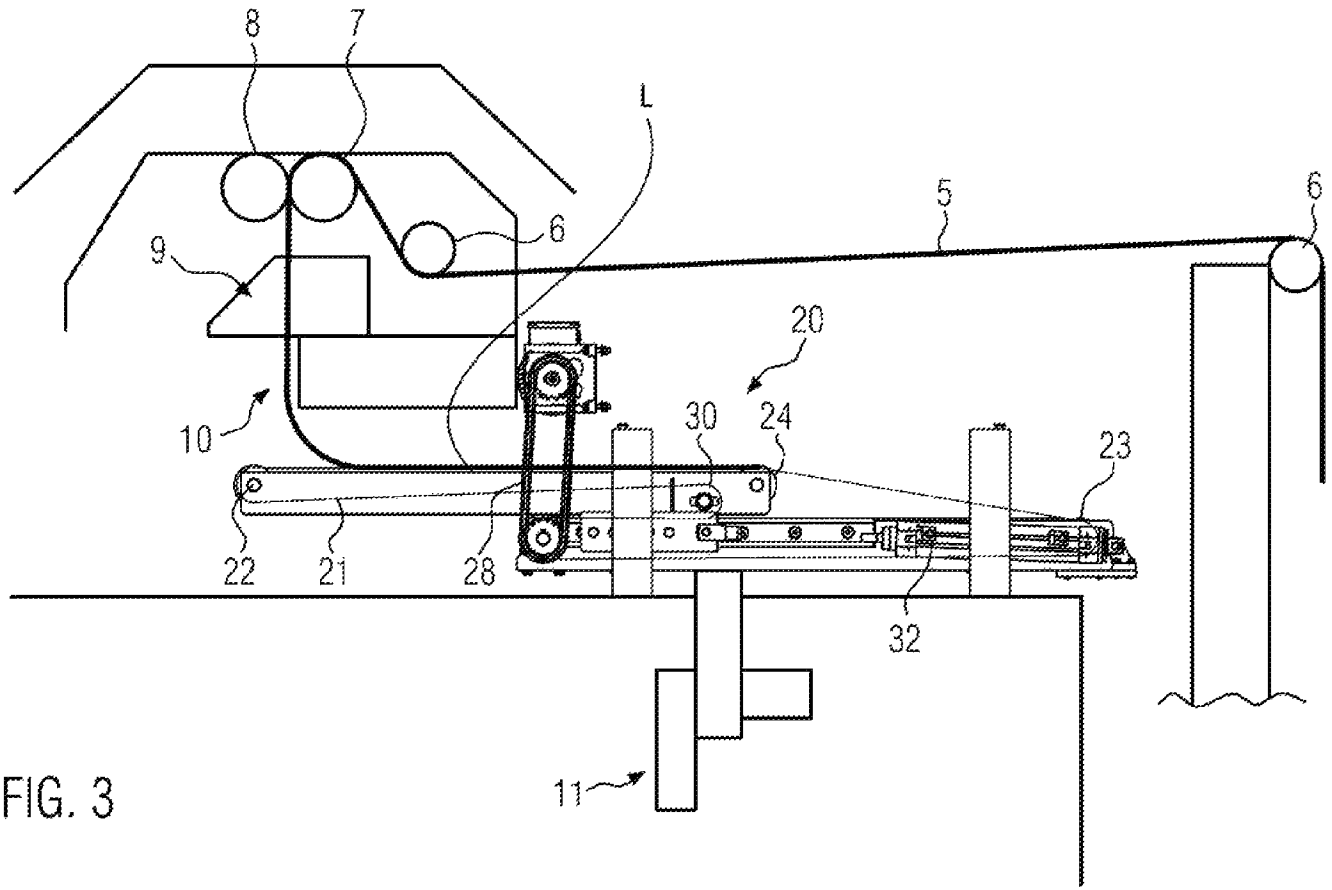

FIGS. 2 and 3 illustrate the discharge device, which is marked with reference sign 20, in the displayed embodiment. The discharge device 20 has a circulating conveyor belt 21, which circulates around a return pulley 22 on the discharge side and a return pulley 23 on the drop-off side. The return pulley 22 on the discharge side can be moved translationally and transversally, i.e. in a horizontal direction. FIG. 2 shows the return pulley 22 on the discharge side in its resting position. FIG. 3 illustrates the return pulley 22 on the discharge side in its discharge position in which the conveyor belt 21 is provided in the gravitational field of the Earth directly underneath the conveyor device 7, 8 and/or the cutting device 9 and/or the sealing jaws 10 so that a length section of the tubular film 5, which is discharged away from the conveyor device 7, 8, arrives directly on the conveyor belt 21. The conveyor belt 21 subsequently diverts the path of the tubular film 5 in the deflecting position according to FIG. 3 from the conveyor device 7, 8 to the intake area for the piece item stack 3 that is defined within the rack 1. To compensate the varying length through movement of the return pulley 22 on the discharge side from the resting position into the discharge position, a second flexible return pulley, which is not displayed in detail and which is held under preload and around which the conveyor belt 21 circulates, is provided.

The return pulley 23 on the drop-off side is located at the edge of the rack 1 so that the discharge path formed on the upper side of the conveyor belt 21 ends outside of the rack 1.

Guiding systems for the suction boxes of the spreading device 11 are formed under the conveyor belt 21. Accordingly, the discharge device is located between the welding device 10 and the spreading device 11.

Figure 4:
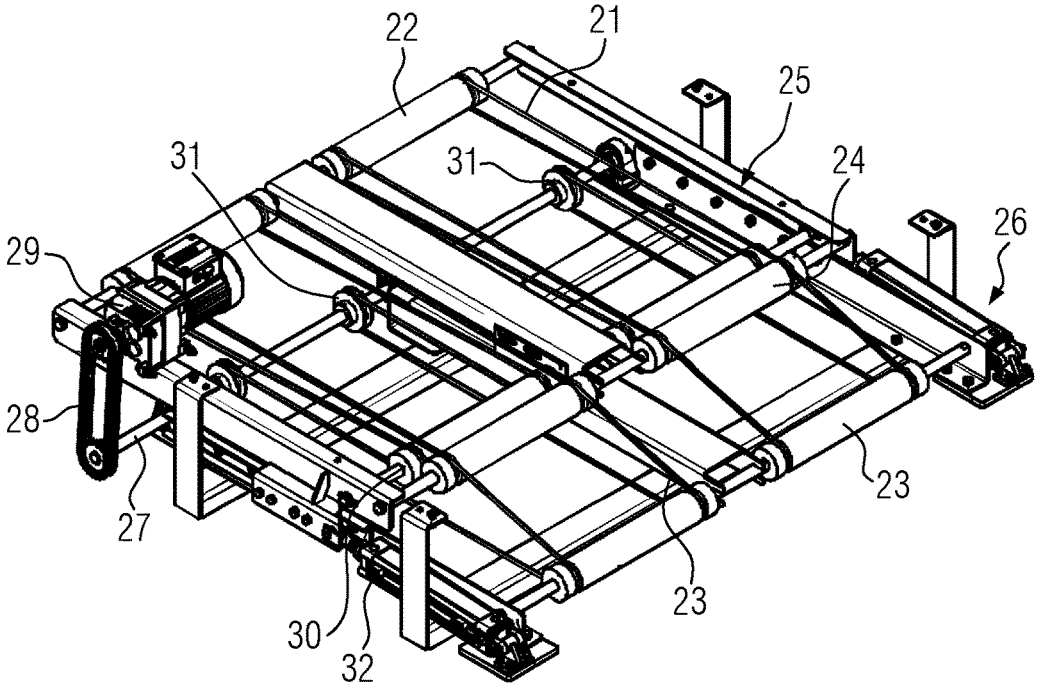

FIG. 4 illustrates the details of the discharge device. As can be seen, the conveyor belt 21 comprises four strands that are stretched in parallel and that are guided over rolls that are equipped with grooves for the intake of the strands. In this context, FIG. 4 shows the discharge device in the resting position in which the sliding frame 25, which holds the return pulley 22 on the discharge side and an upper return pulley 24, covers the holding frame 26 that is located underneath to a considerable extent. On its end on the discharge side, the holding frame 26 carries a drive shaft 27 for the strands of the conveyor belt 21. This drive shaft 27 is coupled with a drive 29 in an actuated way via a chain 28. The holding frame 26 also carries the return pulley on the discharge side. The sliding frame 25 carries an inner return pulley 30 as well as the directly adjacent upper return pulley 24, which, however, is disposed slightly above said inner return pulley in the vertical position. The conveyor belt 21 circulates around all rolls 22, 23, 24, 30 and the drive shaft 27 with the pertaining drive wheels 31 for the respective strands of the conveyor belt 21.

On the outer side of the holding frame 26, support cylinders 32 are provided, which can displace the sliding frame 25 in relation to the holding frame 26 in order to move the sliding frame 25 from the resting position shown in FIGS. 2 and 4 into the discharge position shown in FIG. 3. During this sliding movement, the conveyor belt 21 remains stretched due to the deflection of said conveyor belt over the inner return pulley 30 that is attached to the sliding frame 25. This is because the space increase due to retraction of the sliding frame 25 in the direction onto the discharge position between the return pulley 22 on the discharge side and the return pulley on the drop-off side 23 is equivalent to the reduction of the length between the drive shaft 27 and the inner return pulley 30.

During usual operation of the device for wrapping a stack of goods, the return pulley 22 on the discharge side is in the resting position according to FIG. 2. If the tubular film material of the roll 4 is consumed as part of a wrapping process, a further roll will be fastened on the rack 1. In this process, the further roll can be disposed at the position at which the previous roll 4 was arranged previously. Alternatively, the rack can also have a second holding device for the further following roll. The lagging end of the film, which is provided on the inside of the roll 4, is connected to the leading uncovered end of the further roll after consumption of the roll 4. Afterwards, the conveyor device 7, 8 is operated in order to convey the film material of the tubular film 5 and to dispose said film material past the return pulleys 6 and the two conveyor rollers 7, 8 above the intake area. The length section L that is useless for wrapping of a stack of goods due to the connection point between the leading and the lagging edge is discharged in the process. For this, the length section L is cut free through actuation of the cutting device 9 on its front end as part of the wrapping process of the last piece item stack 2 with the old film material. Subsequently, the conveyor belt 21 is set to the discharge position. The conveyor rollers 7, 8 are operated so that the length section L that is hanging down is conveyed onto the conveyor belt 21 that is driven in a circular way. The length section L is thereby deflected by the moved conveyor belt 21 in an essentially horizontal position and conveyed up to the return pulley on the drop-off side. As part of this horizontal deflection and conveying process, the length section L is cut off on its other end, whereby an uncovered end of the new film material is cut free behind the conveyor rollers 7, 8. The useless length section L is dropped off through further conveying of the conveyor belt 21. It falls off outside of the rack 1 and can, where appropriate, arrive at a collecting tank via a slide. Then, a predetermined length of tubular film for the formation of a tubular hood is pulled off from the tubular film stock in the usual way by means of propulsion of the conveyor rollers 7, 8, separated and welded and pulled over the piece item stack in a way that is known in principle.

REFERENCE SIGN LIST

1 Rack
2 Lane
3 Piece item stack
4 Roll
5 Tubular film
6 Return pulley
7 Conveyor roller
8 Conveyer roller
9 Cutting device
10 Welding device
11 Spreading device
12 Fitting device
13 Gripping finger
14 Drive roller
20 Discharge device
21 Conveyor belt
22 Return pulley on the discharge side
23 Return pulley on the drop-off side
24 Upper return pulley
25 Sliding frame
26 Holding frame
27 Drive shaft
28 Chain
29 Drive
30 Inner return pulley
31 Drive wheel
32 Positioning cylinder
L Length section

What is claimed:

1. An apparatus for wrapping of a piece item stack, which is formed of a plurality of piece item parts that are disposed on top of one another, with a tubular film, the apparatus comprising:

a tubular film stock, a conveyor device for pulling a predetermined length of tubular film out of the tubular film stock, a cutting device for cutting pulled-off tubular film for the formation of a tubular hood, a fitting device, which is positioned downstream of the cutting device in a conveying direction of the tubular film, for pulling the tubular hood over the piece item stack, and a discharge device for discharging a length section of the tubular film, wherein the discharge device is adapted to divert the length section above an intake area for the piece item stack and laterally convey said length section out of the apparatus, wherein the discharge device has a conveyor element that can be moved from a resting position into a discharge position in which the conveyor element is disposed below the cutting device so that the length section, that is conveyed in the conveying direction toward the fitting device, comes in contact with the conveyor element.

2. The apparatus according to claim 1, wherein the discharge device is arranged downstream of the cutting device in the conveying direction of the tubular film.

3. The apparatus according to claim 1, wherein the discharge device is disposed upstream of a spreading device for spreading the tubular film for the encroachment of the fitting device into the tubular film that is open on a bottom side in the conveying direction of the tubular film.

4. The apparatus according to claim 3, wherein the discharge device is disposed between the cutting device and the spreading device.

5. The apparatus according to claim 1, wherein the conveyor device has conveyor rollers that clamp the tubular film and that are disposed on top of the cutting device and that convey the tubular film in the conveying direction onto the cutting device.

6. The apparatus according to claim 1, wherein the conveyor element has a continuously circulating conveyor element that is deflected around a return pulley on a discharge side that is disposed on a edge of a rack that frames a piece item stack to be wrapped.

7. An apparatus for wrapping of a piece item stack, which is formed of a plurality of piece item parts that are disposed on top of one another, with a tubular film, the apparatus comprising:

a tubular film stock, a conveyor device for pulling a predetermined length of tubular film out of the tubular film stock, a cutting device for cutting the pulled-off tubular film for the formation of a tubular hood and a fitting device, which is positioned downstream of the cutting device in a conveying direction of the tubular film, for pulling the tubular hood over the piece item stack, and a discharge device for discharging a length section of the tubular film, wherein the discharge device is arranged downstream of the cutting device in the conveying direction of the tubular film, wherein the discharge device is disposed upstream of a spreading device for spreading the tubular film for the encroachment of the fitting device into the tubular film that is open on a bottom side in the conveying direction of the tubular film, wherein the discharge device has a conveyor element that can be moved from a resting position into a discharge position in which the conveyor element is disposed below the cutting device so that the length section, that is conveyed in the conveying direction toward the fitting device, comes in contact with the conveyor element, and wherein the discharge device is adapted to divert the length section above an intake area for the piece item stack and laterally convey said length section out of the apparatus.

8. The apparatus according to claim 7, wherein the conveyor element has a continuously circulating conveyor element that is deflected around a return pulley on a discharge side that is disposed on an edge of a rack that frames a piece item stack to be wrapped.

* * * * *